US007243897B2

(12) United States Patent
Huber et al.

(10) Patent No.: US 7,243,897 B2
(45) Date of Patent: Jul. 17, 2007

(54) FOUNDATION FOOTING FORM AND ACCESSORIES

(76) Inventors: Donald G. Huber, P. O. Box 64160, Tacoma, WA (US) 98464; Terry Hartman, 20816 60th St. E., Bonney Lk., WA (US) 98390

( * ) Notice: Subject to any disclaimer, the term of this patent is extended or adjusted under 35 U.S.C. 154(b) by 0 days.

(21) Appl. No.: 10/876,977

(22) Filed: Jun. 23, 2004

(65) Prior Publication Data

US 2005/0023432 A1 Feb. 3, 2005

Related U.S. Application Data

(60) Provisional application No. 60/480,896, filed on Jun. 23, 2003.

(51) Int. Cl.
*E04G 17/12* (2006.01)
*B22D 19/02* (2006.01)

(52) U.S. Cl. ..... 249/34; 249/91; 249/216

(58) Field of Classification Search ..... 249/2, 249/3, 4, 5, 6, 7, 8, 9, 34, 207, 208, 213, 249/216, 90, 91, 93, 94, 96; 52/677, 678, 52/687

See application file for complete search history.

(56) References Cited

U.S. PATENT DOCUMENTS 1,616,977 A 2/1927 Koivu
4,340,200 A * 7/1982 Stegmeier ..... 249/3
4,443,981 A * 4/1984 Weiss ..... 249/3
5,120,162 A 6/1992 Parker
5,174,083 A * 12/1992 Mussell ..... 249/5
5,224,799 A 7/1993 Parker
5,399,050 A 3/1995 Jacobus
5,466,092 A 11/1995 Semenza et al.
5,474,400 A 12/1995 Kliefoth et al.
5,475,950 A 12/1995 Palmer
5,535,565 A * 7/1996 Majnaric et al. ..... 249/216
6,021,994 A 2/2000 Shartzer, Jr.

* cited by examiner

*Primary Examiner*—Michael Safavi
(74) *Attorney, Agent, or Firm*—Garrison & Associates PS; David L. Garrison

(57) ABSTRACT

Moisture resistant foundation footing form sections constructed from corrugated plastic are disclosed. Supports for holding sections of reinforcing bar, and connecting the side walls of the form sections are included. Also disclosed are tabs and notches in the side walls for use with stakes to connect adjacent form sections. Form sections are disclosed for constructing a corner in a foundation footing form. Step-down forms are disclosed for constructing a foundation footing form on a construction site having surfaces of different elevations. The form sections can be secured in position with stakes, and leveling devices for leveling the form once it is secured in position are disclosed. The form sections disclosed herein can be reused, but they do not attract insects and therefore they do not have to be removed from finished foundation footings.

11 Claims, 13 Drawing Sheets

FIG. 19
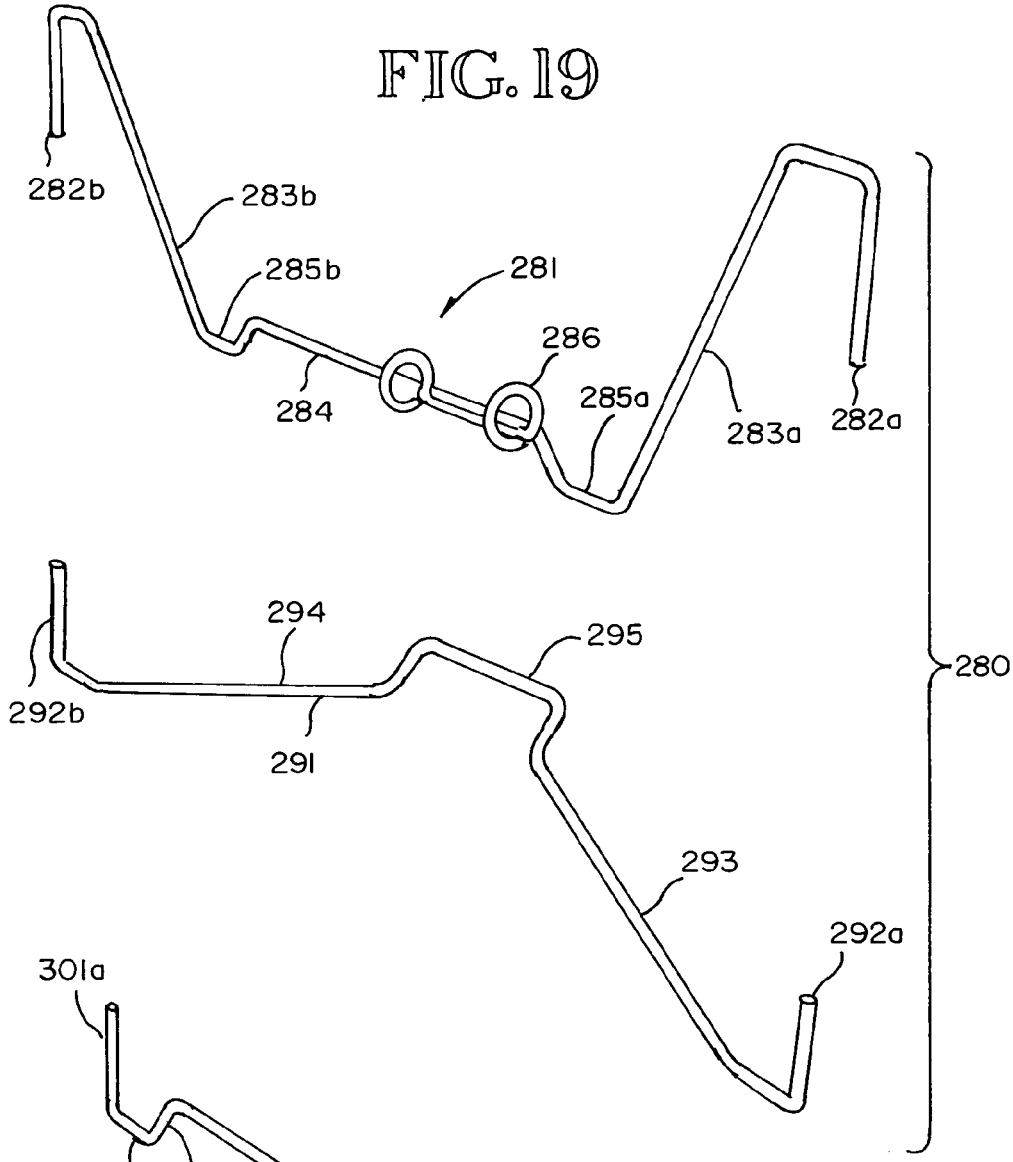
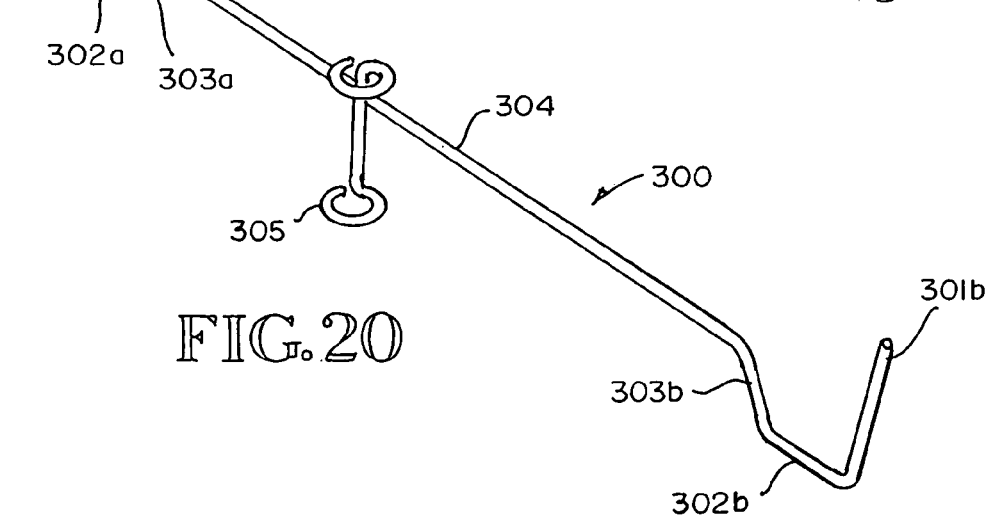
FIG. 20

FOUNDATION FOOTING FORM AND ACCESSORIES

CROSS REFERENCE TO RELATED APPLICATION

This application claims the benefit of U.S. Provisional Application Ser. No. 60/480,896, entitled CONCRETE FORM FOR FOUNDATION FOOTING, filed Jun. 23, 2003.

TECHNICAL FIELD

The disclosure herein relates to an apparatus and method for forming concrete footings, for use in building construction. In particular, this document describes lightweight and collapsible forms, devices for holding re-enforcing bar in the forms, and a method for using the forms.

BACKGROUND OF THE INVENTION

In the art of building construction it is common practice to cast the base or foundation with concrete. A trench or excavation channel is prepared into which the forms, either made from steel or wood, are set up adjacent and connected to each other matching the dimensions of the required foundation (footing). The forms, which are steel panels or wooden boards or planks, are put into position on their edges across from each other and parallel to each other near the side walls of the trench.

The materials that are commonly used for concrete forms are easily damaged. If steel forms are dented or bent, they are essentially useless. Wood forms are difficult if not impossible to use over and over again. Moreover, wood is a precious resource, and thus undesirable for use as a disposable form material.

After being placed into position, the forms are usually secured by stakes and other devices that are sufficient to prevent the form from being displaced. As more and more governments update their respective building codes, the number of locations that require pier blocks to be reinforced with steel is growing. Steel reinforcement generally takes the form of reinforcing bars (re-bar) that is placed in the form in such a manner that the wet concrete completely covers the reinforcing bar. Horizontally oriented reinforcing bar is generally held in place by using separate reinforcing bar mounting stands. Some of the generally available reinforcing bar stands can be connected to the form after the form has been constructed, while others are positioned in the form and the reinforcing bar is placed on the device. Vertically oriented reinforcing bar is generally secured in the form by devices that are connected to the form after it is constructed. Placing the reinforcing bar securing devices in the desired location within the form requires additional labor and some degree of skill.

After the forms are completely assembled and the reinforcing bar has been secured, concrete is poured within the forms and allowed to set and cure. Typically, when the concrete has hardened, the form is removed by a process that is labor intensive, and generally requires as much physical labor and cost as the initial set up. Additionally, concrete can stick to the forming faces of wood, steel and other materials to the point where adequate cleaning is impossible. Release from the concrete once it has set usually requires the use of a release agent or labor-intensive scraping which complicates the construction process.

In addition to the problems noted above, the concrete forms that are generally used for foundation footings can be difficult to handle because of their weight and bulk. These heavy bulky forms generally require at least a medium sized truck to move enough material to create a form for a single-family dwelling. Once the foundation has been completed, the truck must be used again to transport the form to the next job site. The forms must be stored when they are not used for extensive periods of time, which requires significant space. These problems and others add time and costs to foundation construction, which increases the purchase price paid for a newly constructed building by consumers.

A number of inventions have attempted to address the problems associated with conventional foundation footing forms. U.S. Pat. No. 5,399,050, issued to Jacobus discloses thermoplastic side walls that can be connected with bars to create a form with integrated drainage tiles. The form is left in place after the concrete has cured. The Jacobus patent does disclose a device that reduces labor costs by leaving it in place after the concrete has cured, but it still must be assembled on the construction site by connecting the two side walls together. The Jacobus patent does not address the fact that the pre-made side walls may be too long in some instances and may be difficult to cut to the correct size. Additionally, the Jacobus patent does not address the placement of vertical and horizontal reinforcing bar in the form, nor does it provide any means for securing such reinforcing bar in the form.

U.S. Pat. No. 5,475,950, issued to Palmer, discloses a lightweight permanent concrete footing form having a horizontal base with two side walls extending upwardly therefrom. The form disclosed in the Palmer patent also has ducts for draining water away from the completed footing. As with the Jacobus Patent, the disclosure of the Palmer patent does not address how the plastic form can be cut to size, nor does it address reinforcing bar placement or securing the reinforcing bar in the form. Additionally, the devices disclosed in both the Jacobus and Palmer patents include integral drainage conduits and this could make the devices bulky such that they would require significant storage space prior to use and at least a medium sized truck for transportation to the job site.

Thus a need exists for forms for concrete foundation footings that are not made from wood or metal so that these resources can be preserved. Such forms should be lightweight and easily installed by a minimum number of laborers. A need also exists for such forms that would provide integral devices for placing and securing both vertically and horizontally oriented reinforcing bar in the form. Such forms that are, collapsible, easily stored and easily transported would be significant improvements over the prior art.

DISCLOSURE OF THE INVENTION

Accordingly, it is an object of this disclosure to provide an easily assembled pre-fabricated form for the construction of concrete foundation footings.

Another object of this disclosure is to provide such forms that are resistant to the effects of moisture.

Yet another object of the disclosure is to provide such forms that can be easily anchored in their desired position on a construction site.

A further object of this disclosure is to provide such forms that are capable of holding both horizontal and vertical reinforcing bar in a desired location within the form.

It is also an object of this disclosure to provide forms, for constructing concrete footings, that do not need to be removed from the footings once they have set.

A yet further object of this disclosure is to provide forms that are lightweight, collapsible, easily stored and easily transported.

The devices disclosed herein overcome the disadvantages of the prior art with forms assembled from form sections that are pre-fabricated at a remote location and can be quickly installed on a construction site for considerably less cost than wood forms. The forms disclosed herein are resistant to moisture so it can be used in a great variety of climates and they can be assembled in considerably less time by fewer laborers than conventional forms.

The forms disclosed herein are constructed of corrugated plastic. Corrugated plastic is well known material having two parallel facing sheets and spaced, integral interconnecting ribs between the facing sheets. The plastic sheet material can be easily extruded from a variety of plastic resins such as polyethylene, polypropylene, and the like. This material is also referred to as fluted plastic. However, for the purpose of this document, any reference to corrugated plastic is a reference to a material comprising two parallel facing sheets of some plastic composite, having spaced, and integral interconnecting ribs between them.

One preferred embodiment of the form sections has a pair of substantially planar side walls that are connected to each other using interlocking supports, spaced along the length of the form. The supports can be placed in the side walls before shipment, in a form assembly area that is away from the job site, or they can be placed in the forms at the job site. The pre-assembled form sections can then be stored in a collapsed configuration until needed. The supports are used for positioning and securing vertical and horizontal reinforcing bar in the form. In their collapsed configuration the form sections are easily stored and transported.

In use the form sections are placed end to end in the desired shape of the foundation footing to create a form for the footing. The completed form is secured in position by placing stakes through the channels of the corrugated plastic and into the substrate below the form. The forms are then leveled by using leveling devices on the stakes.

In one preferred embodiment, the ends of the form sections have either a tab or a complimentary cut out portion, through which a stake is placed to hold the form sections together. Other embodiments employ a U shaped stake placed in the channels of the corrugated plastic to secure the form sections in position relative to each other, and still other embodiments employ clips that are configured for insertion into the corrugated channels of two adjacent form sections.

On at least one preferred embodiment, the form sections are assembled such that the ends of the opposing side walls are offset by a distance equal to the width of the form. This allows for construction of a foundation footing form where no two points of intersection between adjacent form sections are directly across from each other. The offset ends also allow for the forming of ninety-degree corners without the need for additional material or the need to cut a form section to create a corner. Another embodiment includes a form section specifically designed for ninety-degree corners.

One of the forms disclosed herein is a step down form that can be used where foundation footings are poured on uneven ground that requires a foundation footing to be on different levels. The step down form includes supports for securing reinforcing bar inside of the form. A number of devices for securing the step down form in position, securing reinforcing bar, and leveling the form are also disclosed.

The forms disclosed herein are water-resistant, light weight, easily placed in position, and relatively inexpensive. This application discloses a number of devices for placing and securing reinforcing bar within the forms and a means for leveling the form. The forms are easily stored, and material sufficient for a single family dwelling can be easily transported in a standard sized pickup truck thereby saving on transportation costs. The forms can be set up in a fraction of the time required for forms made from conventional material, thus significant savings can be realized on labor costs.

BRIEF DESCRIPTION OF THE DRAWINGS

The objects and features of the present invention, which are believed to be novel, are set forth in the appended claims. The present invention, both as to its organization and manner of operation, together with further objects and advantages, may best be understood by reference to the following descriptions, taken in conjunction with the accompanying drawings, wherein:

FIG. 19 is a perspective view of another embodiment of an interlocking connection device according to the disclosure herein.

FIG. 20 is a perspective view of another embodiment of a vertical reinforcing bar support member according to the disclosure herein.

BEST MODE OF CARRYING OUT THE INVENTION

Figure 1:
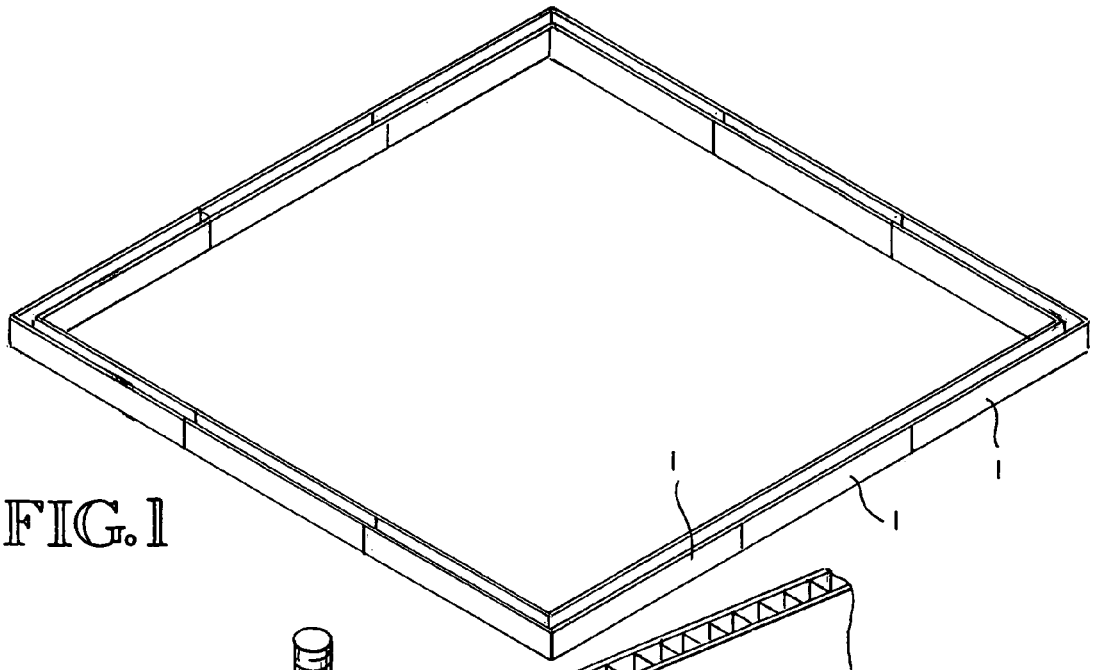
FIG. 1 is an elevated perspective view of a foundation footing form constructed from the form sections disclosed herein.

Turning now to the drawings, the forms and accessories will be described in preferred embodiments by reference to the numerals of the drawing figures wherein like numbers indicate like parts.

Figure 2:
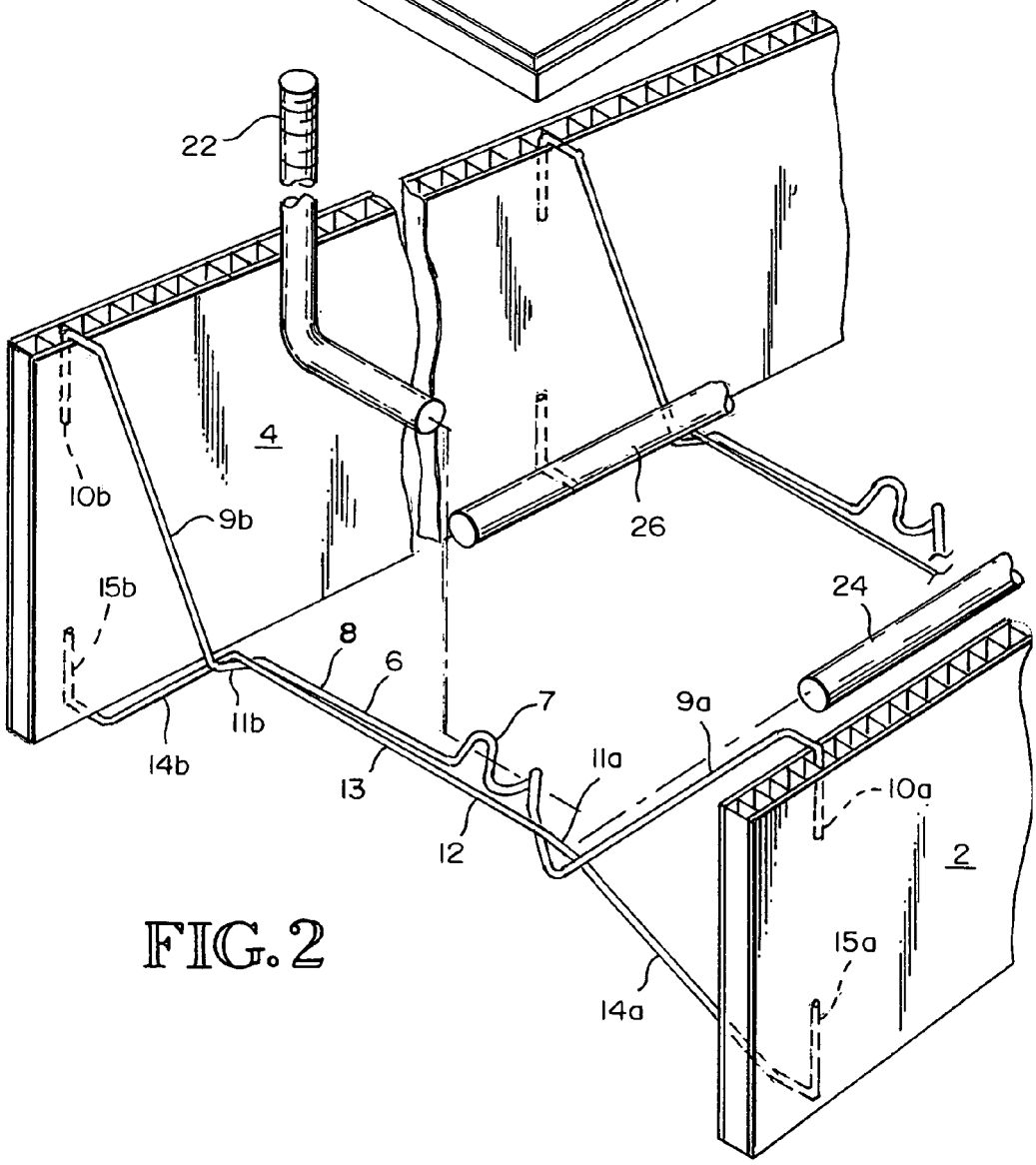
FIG. 2 is a perspective view of the connecting supports used in the form sections disclosed herein.

FIG. 1 shows a foundation footing form assembled from the form sections of the type that is disclosed herein. As seen in FIG. 2 the form sections of the embodiment depicted in the figure, have a pair of substantially planar side walls 2 and 4. The side walls are made from corrugated plastic having spaced, integral interconnecting ribs between two facing sheets. The channels or spaces between the interconnecting ribs are oriented at a right angle to the long axis of the form sections such that they are vertical when the form is placed on the substrate at a job site.

The side walls are connected by interconnecting top supports 6 and bottom supports 12, a plurality of which can be located along the length of the form section. In one preferred embodiment, the side walls of the form section are ten feet in length, and the supports are placed every two feet along the side walls. However, other preferred embodiments have side walls that can be longer or shorter than ten feet, and the supports can be spaced at intervals greater than or less than two feet. The corrugated plastic used to construct the forms can be any thickness that is sufficient to resist deformation under the hydrostatic pressure of non-cured concrete in the forms, and the corrugated plastic in at least one preferred embodiment is one-half of an inch thick.

The top support 6 is configured so that it can be placed in the space between the two side walls 2, 4 of a form section. The support 6 has ends 10*a*, 10*b* that are bent such that the ends are configured for placing into the space between the integral interconnecting ribs of the corrugated plastic (channels) located on the top edge of the side walls 2, 4. The top support will rest on the top edge of the side walls and a pair reinforcing bar guide members 9*a*, 9*b* are angled down and into the space between the side walls 2, 4. The top support cross member 8 is connected to the reinforcing bar guide members 9*a*, 9*b*, and is oriented at a right angle to the side walls when the form section is secured in place.

The top support has a reinforcing bar holding portion 7 for placement of the base of an L shaped section of reinforcing bar 22 (commonly referred to as a J-bar). In the embodiment depicted in FIG. 2, the reinforcing bar holding portion 7 is an integral loop in the cross member 8. The top support also has a pair of recessed areas 11*a*, 11*b* for supporting horizontal reinforcing bar that is placed in an assembled footing form to provide additional strength to foundation footing.

The bottom support 12 has ends 15*a*, 15*b* that are bent such that the ends are configured for placing in the channels located on the bottom edge of the side walls 2, 4 of a form section. Angled bottom support leg members 14*a*, 14*b* angle upward into the area between the two side walls 2,4. The leg members 14*a*, 14*b* are connected to a bottom support cross member 13 that is located within the form section between the side walls.

To assemble the form section embodiment disclosed in FIG. 2, the first end 10*a* of the top support 6 is placed in a channel on one of the side walls 2 and the second end 10*b* of the top support is placed in a channel of the opposite side wall. The first end 15*a* of the bottom support is placed in the same channel of the side wall 2 as first end 10*a* of the top support such that the first end 15*a* of the bottom support is directly below the first end 10*a* of the top support. The second end 15*b* of the bottom support is placed in the same channel of the opposite side wall 4 as the second end 10*b* of the top support such that the second end 15*b* of the bottom support is directly below the second end 10*b* of the top support.

The bottom support cross member 13 is then pulled over top support cross member 8 such that the bottom support cross member 13 rests in the horizontal reinforcing bar support areas 11*a*, 11*b* of the top support 6 thereby interlocking the bottom support with the top support. Additional top and bottom supports are placed along the length of the form section in the same manner.

Figure 2A:
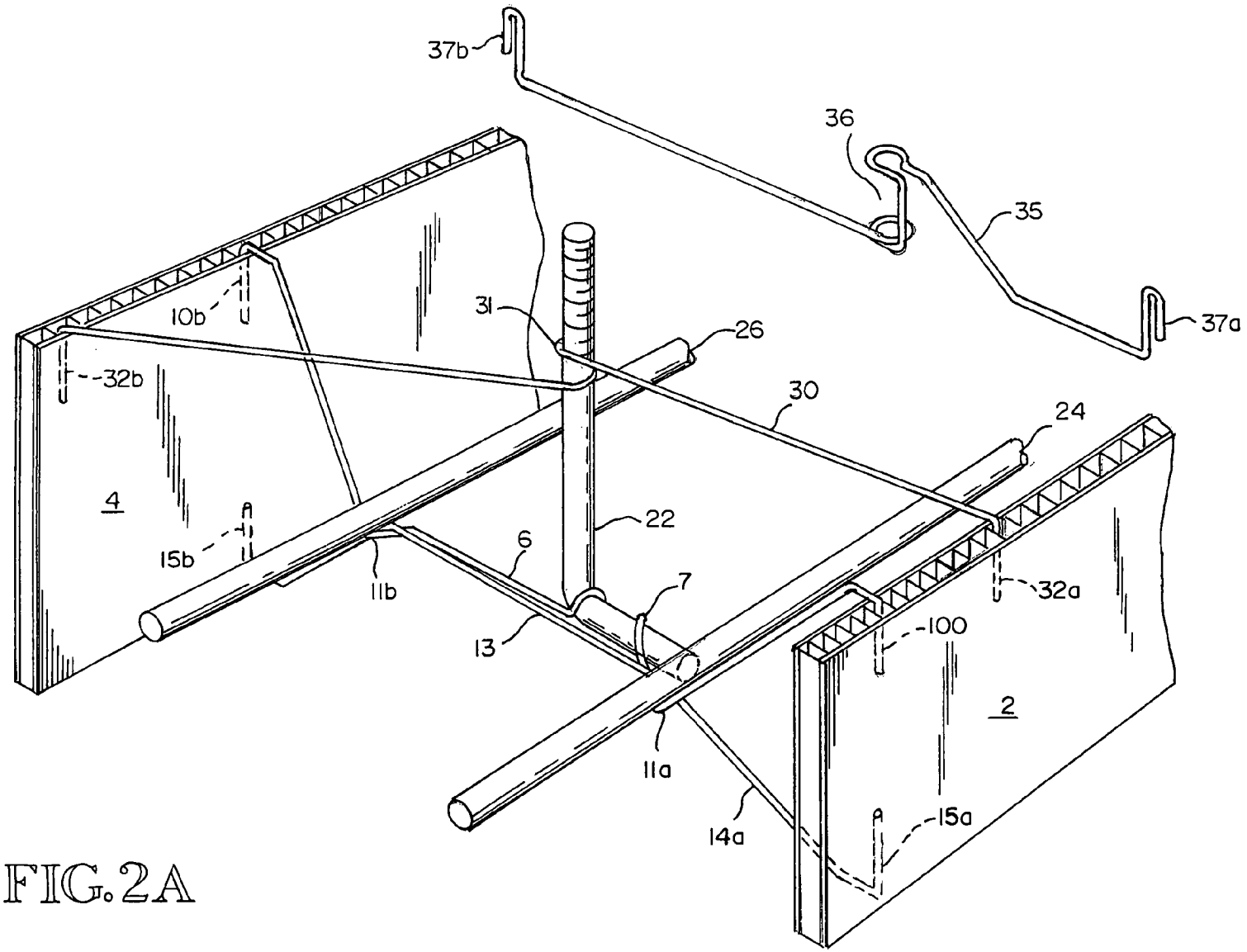
FIG. 2A is a perspective view of the connecting supports and the vertical reinforcing bar supports for securing reinforcing bar within the form sections disclosed herein.
Figure 3:
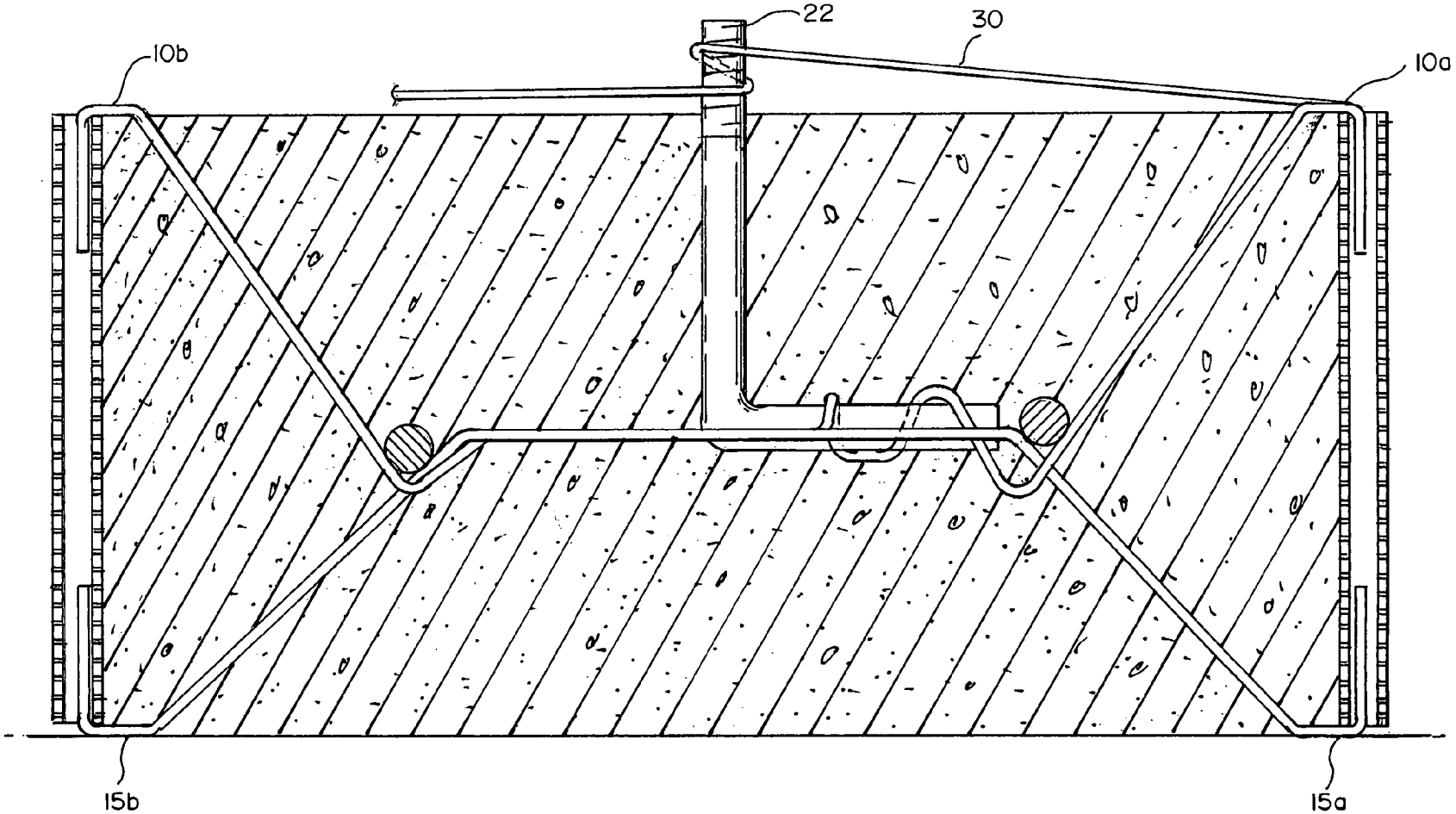
FIG. 3 is a cross-sectional end view showing a form section disclosed herein after it has been filled with concrete.
Figure 4:
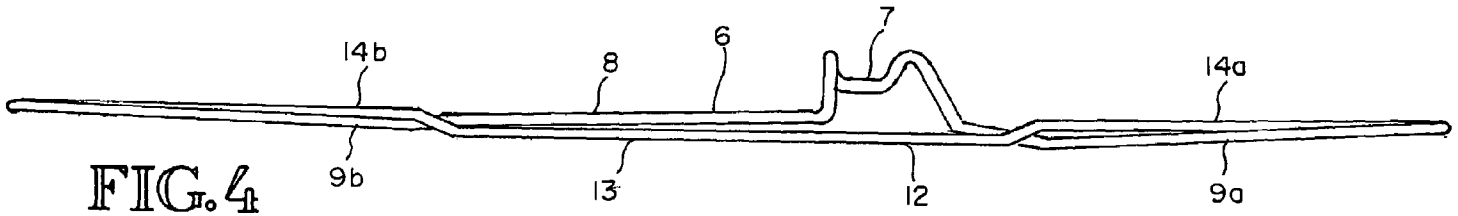
FIG. 4 is a view from above showing the interlocking supports used in the form sections disclosed herein.

FIG. 4 shows the interlocked top support and bottom support of the embodiment depicted in FIGS. 2, 2A, and 3 as seen from above. In the figure, the cross member 13 of the bottom support is placed over the cross member of the top support. The reinforcing bar guides 9*a*, 9*b* press against the bottom support legs 14*a*, 14*b* such that the bottom support cross member 13 is held firmly against the top support cross member 8.

Once the bottom support and top support are interlocked, the ends of the supports will not come out of the channels of the side walls until the bottom support cross member is lifted out of the horizontal reinforcing bar notches and over the top support cross member. When the supports are interlocked, the side walls can be folded together by moving one of the side walls forward or backward, relative to the other side wall, along the long axis of the side wall and allowing the supports to pivot around the ends located in the channels such that the supports are sandwiched between the two side walls. The folded form sections can then be stacked for storage or transportation.

FIG. 2A shows an embodiment of a form section with the top and bottom supports installed and interlocked as described above. For the embodiment depicted, horizontal reinforcing bars 24, 26 are placed inside the form and rests in the reinforcing bar notches 11*a*, 11*b* of the top support. The base of the L-shaped section of reinforcing bar 22 is secured in the reinforcing bar holding loop 7 such that the long stem of the L-shaped section of reinforcing bar 22 extends vertically from the inside of the form section.

Also shown in FIG. 2A are two preferred embodiments of vertical reinforcing bar supports 30, 35. The vertical reinforcing bar support members maintain the vertical orientation of the long stem of the L-shaped section of reinforcing bar 22 and prevent it from rotating into the form section before concrete has been poured into an assembled footing form.

One embodiment of vertical reinforcing bar support 30 has first end 32*a* and second end 32*b* that are bent so that they are configured for placement in the channels of the corrugated side walls such that the support 30 rests on the upper edge of the side wall. The support 30 also has a reinforcing bar holding loop 31 for securing the L-shaped section of reinforcing bar.

In use the reinforcing bar holding loop 31 is placed over the long stem of the L-shaped section of reinforcing bar such that the ends 32*a*, 32*b* are oriented downward towards the form section. The first end 32*a* of the vertical reinforcing bar support is then placed in a channel in the corrugated plastic side wall 2 and the second end 32*b* is placed in a channel in the corrugated plastic side wall 4 such that the vertical reinforcing bar support extends across the form section at an oblique angle to the side walls. After concrete has been poured into the form and allowed to cure, the vertical reinforcing bar support 30 can be removed.

Another embodiment of a vertical reinforcing bar support 35 has first end 37*a* and second end 37*b* that are configured for placement in the channels of the corrugated side walls and a reinforcing bar holding loop 36 for securing the L-shaped section of reinforcing bar. In use the reinforcing bar holding loop 31 is placed over the long stem of the L-shaped section of reinforcing bar such that the ends 37*a*, 37*b* are oriented downward towards the form section. The first end 37*a* of the vertical reinforcing bar support is then placed into the same channel in the corrugated plastic side wall 2 that the first end of the top support is located in, and the second end 37*b* is placed in the same channel in the corrugated plastic side wall 4 that the second end 32*b* of the top support is located in. The vertical reinforcing bar support member 35 remains in the foundation footing after concrete has been poured into the form.

Preferred embodiments of the top support the bottom support, and the vertical reinforcing bar supports can be made from metal having sufficient ductility to allow it to be shaped while retaining sufficient strength such that the supports will not deform when supporting reinforcing bar or when concrete is poured into the form.

FIG. 3 is a cross sectional view showing a preferred embodiment of the form after concrete has been poured into the space between the side walls. After the concrete has cured, the vertical reinforcing bar support 30 can be removed. The footing form can be left in place, or the top support can be cut near the ends 10*a*, 10*b* and the side walls can then be removed. The top support and the bottom support remain in the footing substantially surrounded by cured concrete except for the ends 10*a*, 10*b*, 15*a*, 15*b*.

Figure 5:
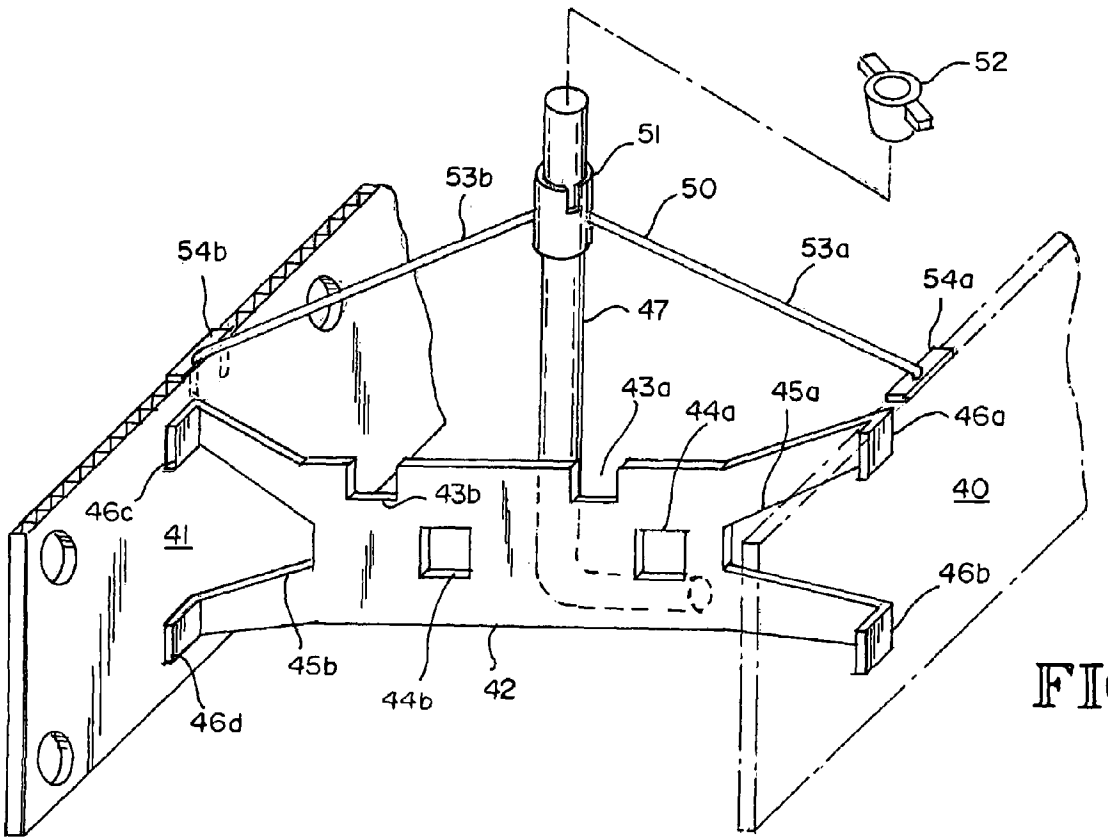
FIG. 5 is a perspective view showing an alternative embodiment of a form section and reinforcing bar holder as disclosed herein.
Figure 7:
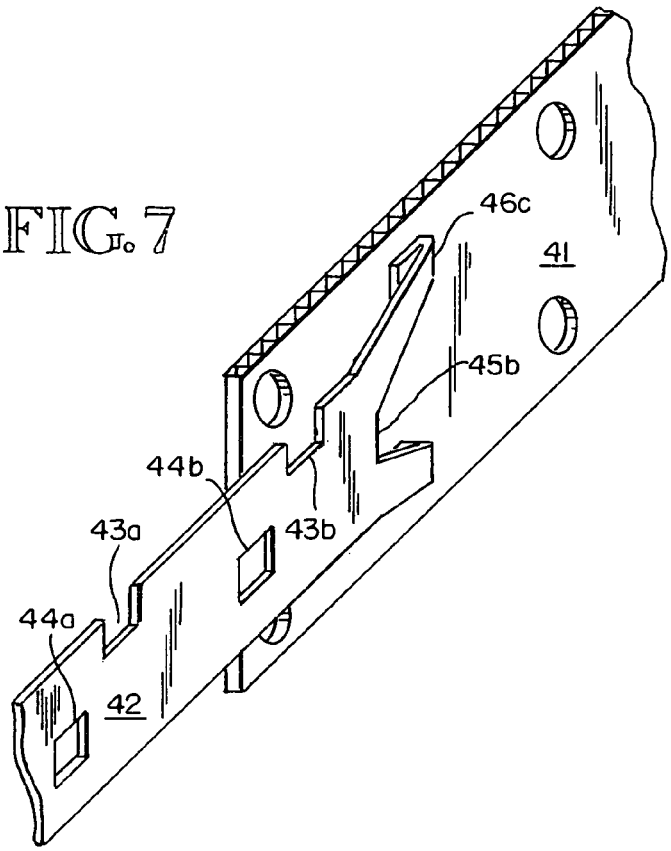
FIG. 7 is a view of an alternative embodiment of a vertical reinforcing bar support according to the disclosure herein.
Figure 6:
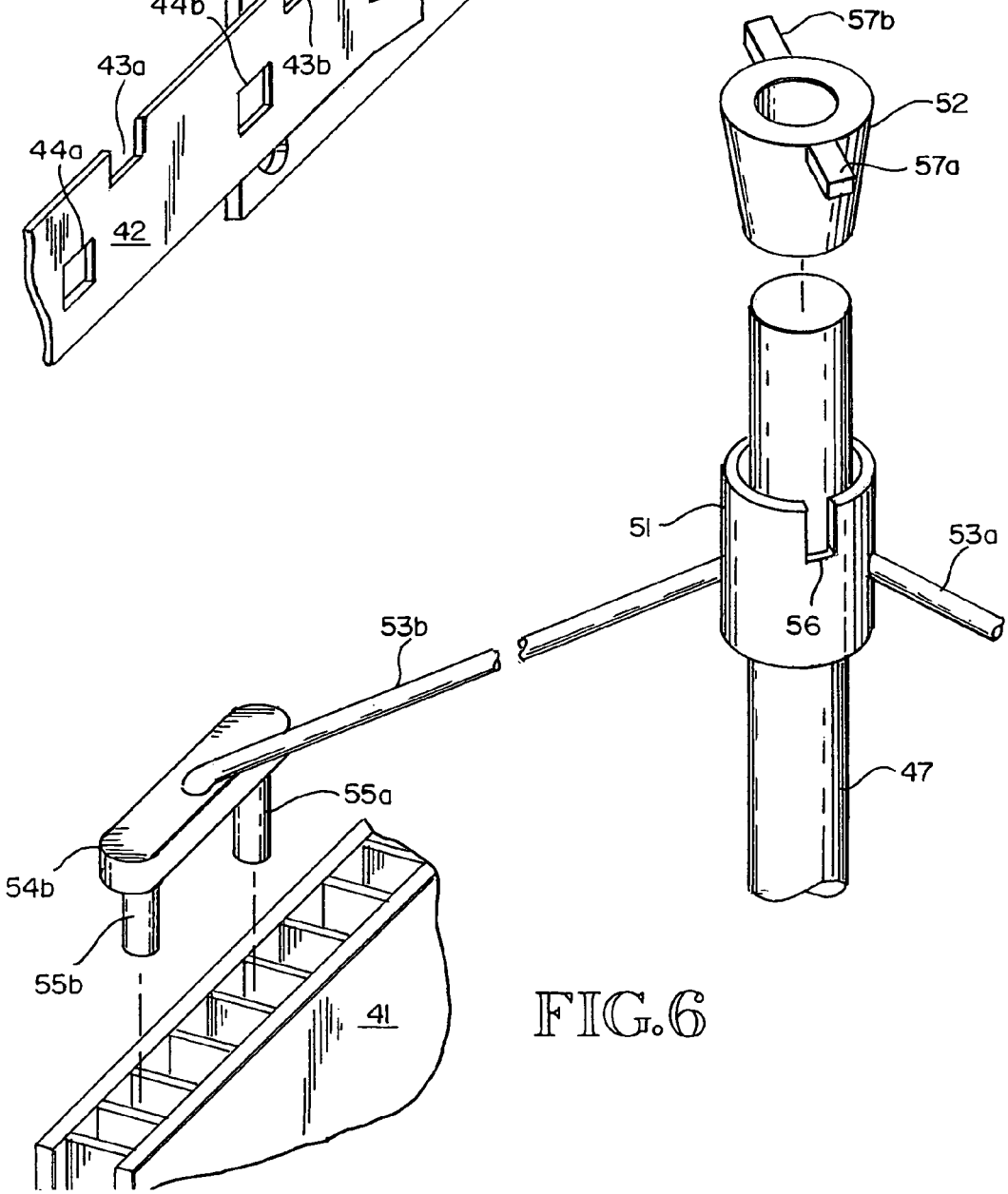
FIG. 6 is a perspective view showing one wall and a reinforcing bar support of an alternative embodiment of a reinforcing bar holder according to the disclosure herein.

FIG. 5, FIG. 6 and FIG. 7 depict another preferred embodiment of a form section according to the disclosure herein, along with another embodiment of a vertical reinforcing bar holder. In the embodiment depicted in the figure, the form section has a pair of substantially planar side walls 40, 41 that are constructed from corrugated plastic. The side walls are connected to each other by a plurality of connecting support members 42 that are spaced along the length of the form section. The connecting support members are also constructed from corrugated plastic and connected to the side walls with adhesive or mechanical fasteners at two points on each side wall 46*a*-46*d*.

The connecting support members have reinforcing bar support notches 43*a*, 43*b* for holding horizontal reinforcing bar in the form such that the reinforcing bar will be completely surrounded by concrete when concrete is poured into the space between the two side walls. The connecting support members 42 also have a vertical reinforcing bar support clip 79 (FIG. 10) for securing the base of an L-shaped section of reinforcing bar in the space between the two side walls.

The connecting support member has concrete communication holes 44*a*, 44*b* in the member, and end notches 45*a*, 45*b* to allow concrete communication therethrough. When concrete is poured into the space between the two side walls, the holes 44*a*, 44*b* and notches 45*a*, 45*b* allow the concrete to communicate through and around the ends of the connecting support member such that the footing maintains a uniform strength along its length. As can be seen in FIG. 5 and FIG. 7, the top edge of the connecting support member is lower than the top edge of the side walls and the bottom edge of the support member is higher than the bottom edge of the side walls thereby allowing continuity of the concrete above and below the connecting support member.

While it is not shown in FIG. 5 or FIG. 7, at least one preferred embodiment of the type of connecting support member depicted in the figures includes stiffeners that are located inside the connecting support member. The stiffeners are made from a metal rod or wire of suitable strength and they are placed between the two parallel facing sheets of the corrugated plastic that makes up the connecting support member, such that they are oriented at right angles to the spaced, integral interconnecting ribs between the facing sheets.

As with the embodiment of the form sections of the current invention shown in FIG. 2, the side walls of the embodiment shown in FIG. 5 can be folded together by moving one of the side walls forward or backward, relative to the other side wall, along the long axis of the side wall such that the supports are sandwiched between the two side walls. The folded form sections can then be stacked for storage or transportation.

Also shown in FIG. 5 and FIG. 6 is another embodiment of a vertical reinforcing bar support. The vertical reinforcing bar support 50 has a reinforcing bar collar 51, a collar lock 52, a pair of cross members 53*a*, 53*b*, and a pair of side wall engaging members 54*a*, 54*b*.

When this embodiment of the vertical reinforcing bar support is used, referring to FIG. 6, the reinforcing bar collar 51 is placed over the long stem of the L-shaped section of reinforcing bar 47 that extends vertically from the space between the two side walls. The support 50 is oriented such that the pegs 55*a*, 55*b* on the bottom of the side wall engaging member 54*b* are oriented downward. The pegs on the side wall engaging members are then placed in channels between the integral ribs of the corrugated plastic side walls. The collar lock 52 is placed over the reinforcing bar with the tapered end of the collar lock below the collar engaging nubs 57*a*, 57*b*. The tapered portion of the collar lock slides between the vertically oriented reinforcing bar and the reinforcing bar collar until the collar lock is securely wedged into the space between the collar and the reinforcing bar and the collar engaging nubs are located in the collar slots 56.

After concrete has been poured into the space between the side walls of the embodiment of the form section depicted in FIG. 5 through FIG. 7, the form remains on the cured foundation footing, but the vertical reinforcing bar support is removed and can be re-used.

Figure 8:
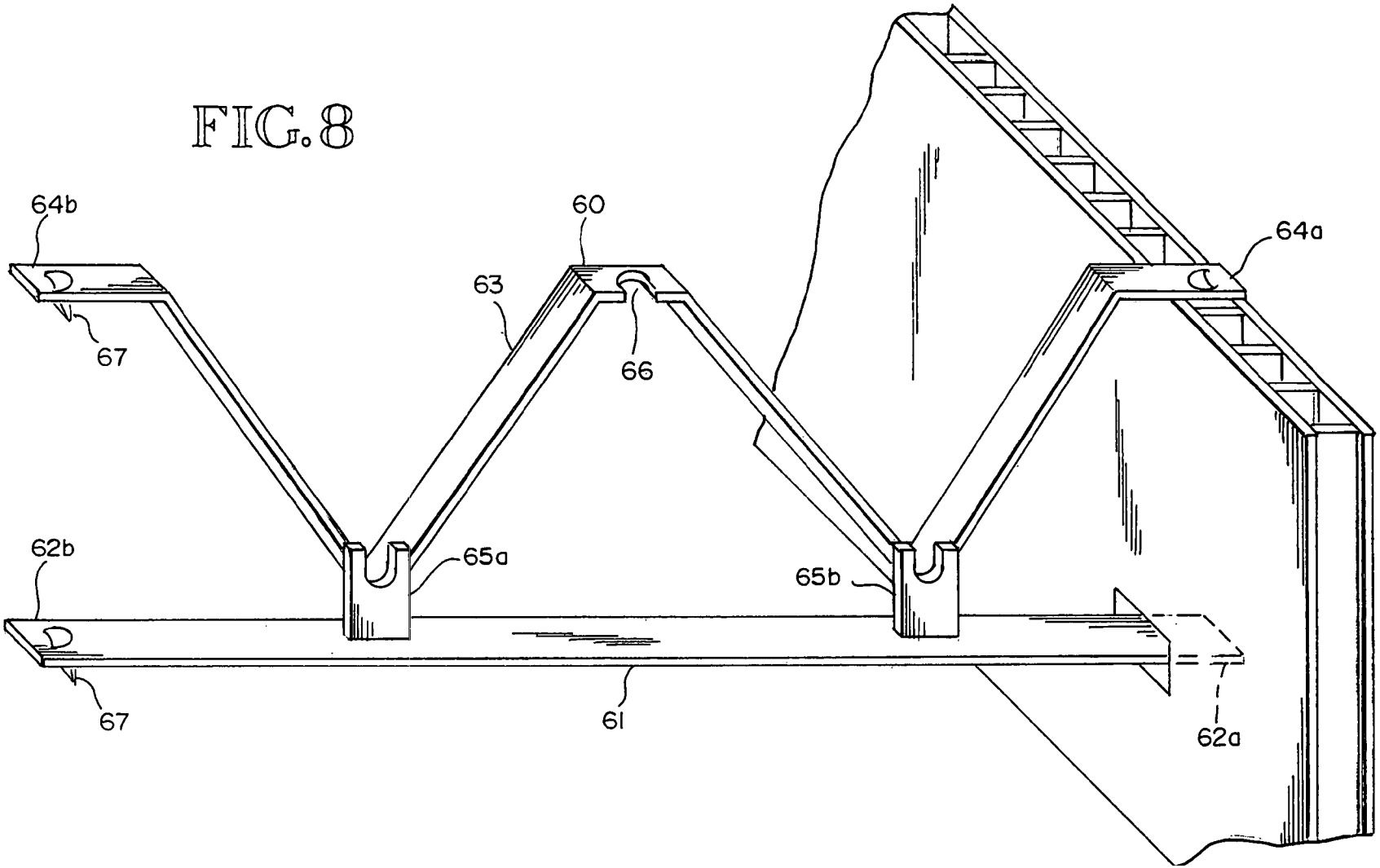
FIG. 8 is a perspective view of another embodiment of a reinforcing bar support that is disclosed herein.

FIG. 8 shows another embodiment of a connecting support for use with the form sections disclosed herein. The embodiment depicted in the figure has a connecting support 60 with a horizontal cross member 61 and an essentially W-shaped support member 63. The ends 62*a*, 62*b* of the horizontal cross member are inserted into holes that are pre-cut in the walls of the side walls of the form, and the ends 64*a*, 64*b* of the support member rest on the top edge of the side walls. At the ends of each member there is a nib 67 on the bottom of the member that is placed in a channel in the corrugated plastic to prevent the connecting support from moving. A pair of horizontal reinforcing bar clips 65*a* and 65*b* are located at the base of the support member and a vertical reinforcing bar clip 66 is located at the top center of the support member.

In use, the embodiment of form sections having the connecting support depicted in FIG. 8 are generally assembled at the construction site. If desired, horizontal reinforcing bar is secured in the horizontal reinforcing bar clips 65*a*, 65*b* and vertical reinforcing bar is secured in the vertical reinforcing bar clip 66. A vertical reinforcing bar support as described above can then be used if desired, and concrete is poured into the space between the forms. After the concrete has cured, the side walls can be left in place or removed and re-used, but the connecting support remains in the foundation footing.

Figure 9:
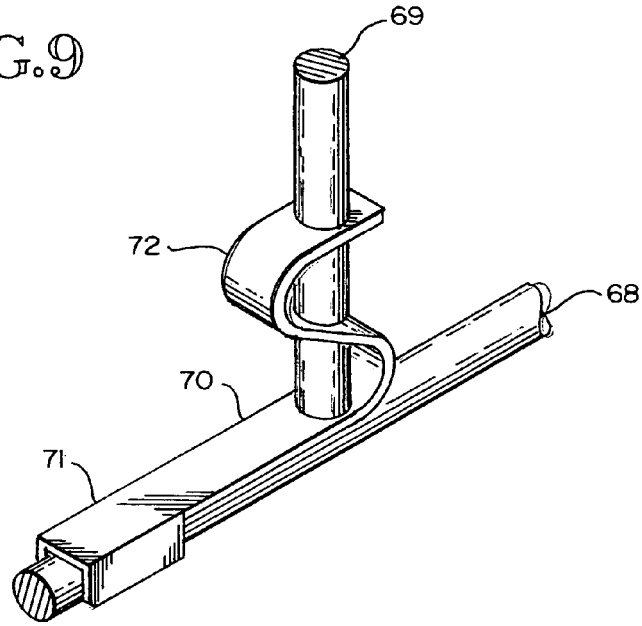
FIG. 9 is a view of yet another embodiment of a reinforcing bar support as disclosed herein.

FIG. 9 shows another preferred embodiment of a vertical reinforcing bar holder. The reinforcing bar holder 70 can be used to place vertical reinforcing bar 69 in a form section without attaching the vertical reinforcing bar to a connecting support or any of the supporting or connecting devices previously disclosed herein. The holder 70 depicted in the figure, has a horizontal portion 71 that can be secured to the top of a section of horizontally oriented reinforcing bar 68 and an essentially S-shaped portion having holes communicating therethrough for placement of a vertically oriented section of reinforcing bar.

In use, the vertical reinforcing bar holder can be used for placing vertically oriented sections of reinforcing bar in a form section between the previously disclosed connecting or supporting devices. The horizontal portion is secured to the top of a section of horizontal reinforcing bar and a section of reinforcing bar is placed through the holes in the S-shaped portion of the reinforcing bar holder.

Figure 10:
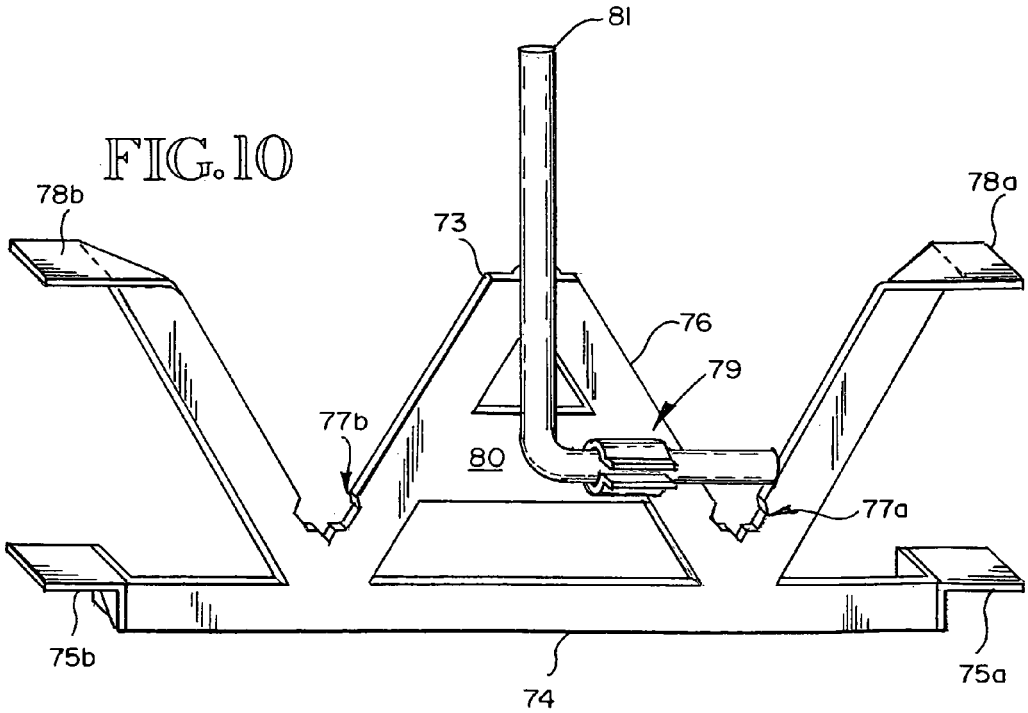
FIG. 10 is a view of still another embodiment of a reinforcing bar support according to the disclosure herein.

FIG. 10 depicts anther embodiment of a connecting. The connecting support 73 that is depicted in the figure has a horizontal cross member 74 and an essentially W-shaped support member 76. The ends 75*a*, 75*b* of the horizontal cross member are inserted into holes that are pre-cut in the walls of the side walls of the form, and the ends 78*a*, 78*b* of the support member rest on the top edge of the side walls. The ends are then secured to the form section side walls with a pin inserted through the ends and into a channel in the corrugated plastic side walls or secured to the side walls with a fast acting adhesive. A pair of horizontal reinforcing bar clips 77*a* and 77*b* are located at the base of the support member and a vertical reinforcing bar clip 79 is located on support cross member 80 that is part of the support member 76.

In use, form sections having the connecting support depicted in FIG. 10 are generally assembled at the construction site. If desired, horizontal reinforcing bar is then secured in the horizontal reinforcing bar clips 77*a*, 77*b* and the base of an L-shaped section of reinforcing bar 81 can be secured in the vertical reinforcing bar clip 79. A vertical reinforcing bar support as described above can then be used to prevent the long stem of the L-shaped section of reinforcing bar from rotating into the space between the side walls, and concrete is poured into the space between the forms. After the concrete has cured, the side walls can be left in place or removed and re-used, but the connecting support remains in the foundation footing.

Often it is the case that a foundation footing must be poured on a location that can not be completely leveled such that the entire foundation is on one level. When this occurs, the area for the foundation is prepared such that part of a foundation footing will be poured on a first level surface and the remainder of the foundation footing will be poured on one or more level surfaces that have an elevation that is greater than or less than the first level surface. When this condition exists at a construction site, a form commonly referred to as a step-down form is used.

Figure 11:
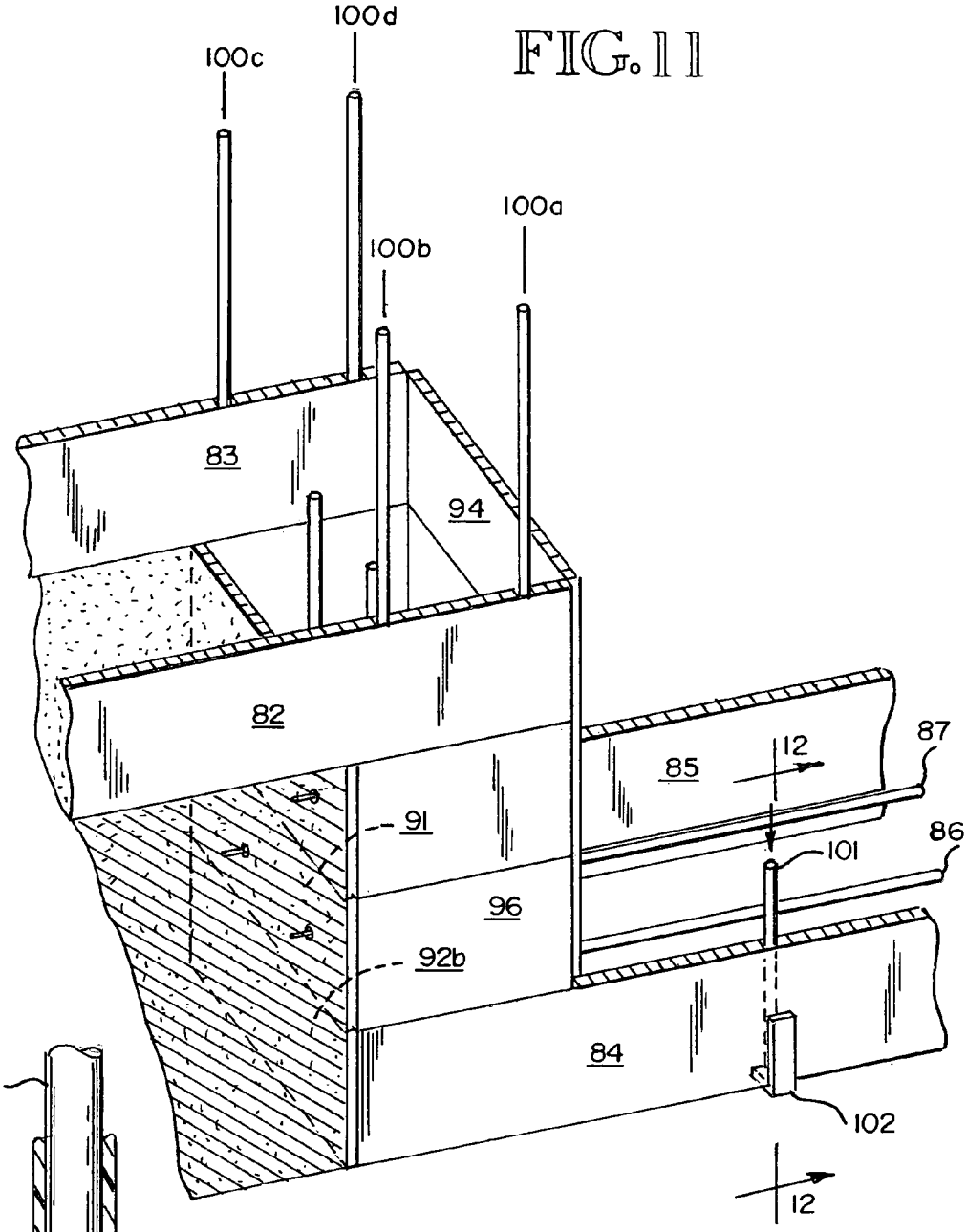
FIG. 11 is a perspective view of a step down form according to the disclosure herein.
Figure 13:
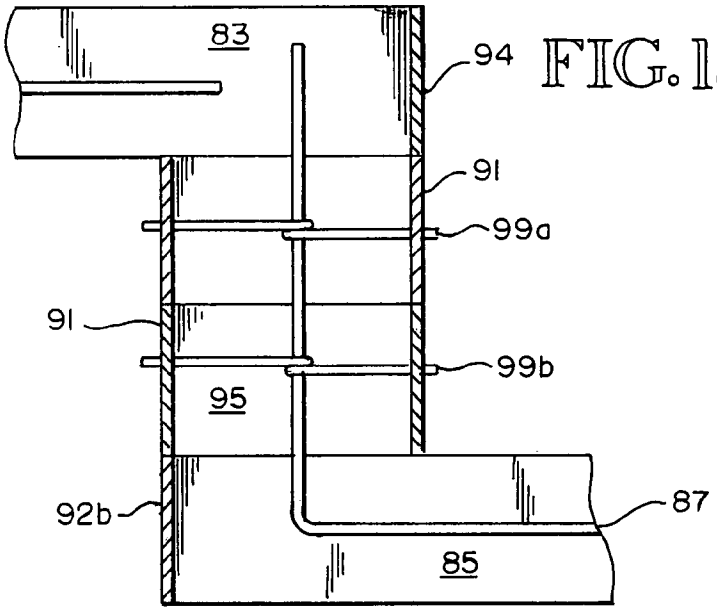
FIG. 13 is a cross-sectional view of a step down form, disclosed herein, showing vertical reinforcing bar and the reinforcing bar supports used therein.
Figure 14:
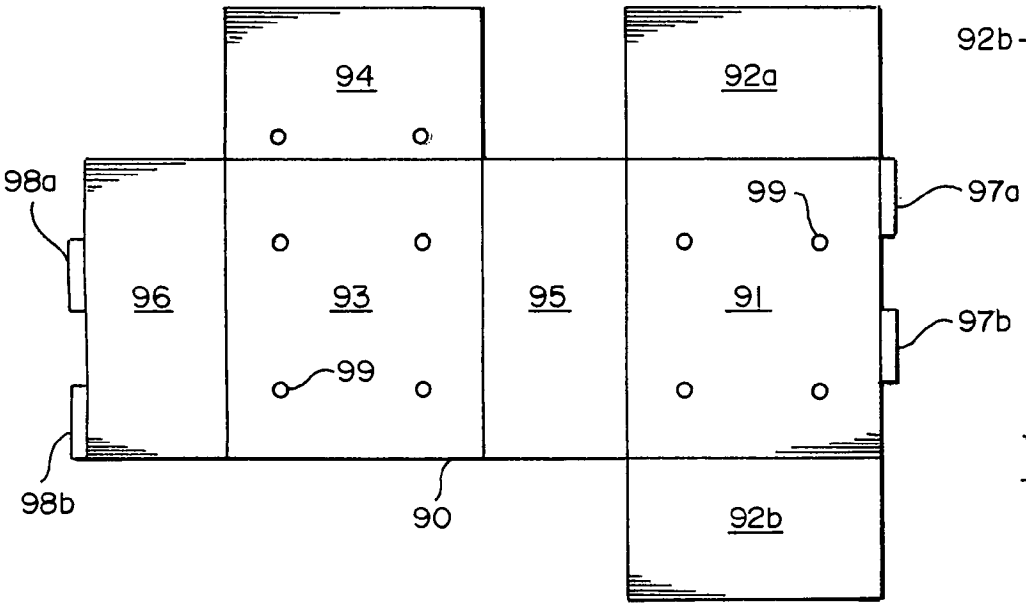
FIG. 14 is a plan view of the step down form, according to the disclosure herein, in its unassembled state.

FIG. 11, FIG. 13, and FIG. 14 show a preferred embodiment of a step-down form according to the disclosure herein. Referring to FIG. 14, a preferred embodiment of the step-down forms will arrive at a construction site in its disassembled state. The step down form depicted in the figures is constructed from the same type of corrugated plastic as the previously disclosed footing form sections.

The step-down form 90 has a back wall 91 with two back wall panels 92*a*, 92*b*, a front wall 93 with a front wall panel 94, and a pair of side walls 95, 96. In the depicted embodiment, the back wall 91 and the front wall 93 both have a plurality of holes 99 communicating therethrough for insertion of vertical reinforcing bar support members. However, it only matters that the step down forms have holes in at least one set of opposing walls and other embodiments include holes in the side walls.

Tabs 97*a*, 97*b*, 98*a*, and 98*b* are located along the edge of the back wall 91 and one of the side walls. The tabs will line up with each other when the form is assembled, and a stake can be placed in the channel between the ribs of the corrugated plastic of the tabs thereby to keep the step-down form in its assembled configuration.

Referring to FIG. 11, after the construction site has been prepared, the foundation footing sections are laid end to end in the desired shape of the foundation, and where there is an elevation difference between two surfaces, each having part of the foundation, a step down form is used. The form section for the lower portion of the foundation footing is placed such that the ends of the side walls 84, 85 abut the substrate and sections of reinforcing bar 86, 87 are placed in the form. The step-down form is then assembled and placed such that the back wall 91 abuts the substrate and the side walls 95, 96 rest directly on the side walls 84, 85 of the footing form section.

The footing form section for the surface with the higher elevation is then placed on top of the step-down form such that the side-walls 82, 83 rest on the side walls 95, 96 of the step down form. The front wall panel 94 closes off the end of the upper footing form section and the back wall panel 92*b* closes off the end of the lower footing form section. Long rods 100*a-d* are then placed in the corrugated channels of the upper form section, through the channels in the step-down form (including the channels in tabs 97*a*, 97*b*, 98*a*, 98*b*), through the channels in the lower form section and into the substrate to secure the forms in position relative to each other and relative to the desired location on the construction site.

The channels in the corrugated plastic of the form depicted in the figures are vertically oriented when the form is in use, so that the form can be secured to the footing form sections and the substrate. Additionally, the step down form and the footing form sections on the upper and lower surfaces can be cut so that they will be the appropriate length or height for use at the intersection of the two surfaces.

FIG. 13 shows a cross-sectional view of the footing form shown in FIG. 11. The side wall 83 of the upper form section rests on the side wall 95 of the step-down form, which rests on the side wall 85 of the lower form section. The horizontal reinforcing bar 87 in the lower form section is bent such that it rises vertically through the step down form. While not depicted, the horizontal reinforcing bar in the upper form section would also be bent such that it would descend vertically into the step down form and the two sections of reinforcing bar would be secured to each other by the reinforcing bar support members 99*a*, 99*b* of the step-down form.

In use, the lower form section is trimmed if necessary and put in place. Reinforcing bar having a ninety-degree bend such that the portion after the bend is the same length as the step down form. The reinforcing bar is placed in the lower form and the section after the bend is oriented upward.

The step down form is trimmed if necessary and assembled. The assembled step down form is then lowered onto the lower form section such that the loop in the reinforcing bar support members are placed over the vertical section of the reinforcing bar.

The upper form section is then trimmed if necessary and placed on the step-down form. The upper form can include reinforcing bar that is bent like that in the lower form, which then can be oriented into the form. The reinforcing bar support members used for the step-down form are similar to the vertical reinforcing bar support 30 shown in FIG. 2A. However, the reinforcing bar holding loop on the reinforcing bar support members 99*a*, 99*b* in the step-down form are large enough to accommodate two sections of reinforcing bar.

Although not depicted in the figures, an alternative embodiment of the step-down form utilizes stiff collars to maintain the step-down form in its assemble configuration instead of the tabs shown on the step-down form depicted in FIG. 14. The collars constructed from any material having sufficient strength to resist the lateral pressure of concrete that will be poured in the step-down form and that can be configured to maintain its shape. The collars are shaped such that the interior perimeter of the collar is complimentary to the exterior shape of the step-down form. After the step-down form has been assembled at least one collar is placed around the exterior of the step down form before it is secured with rods to the footing form sections as described above.

When a foundation footing form is constructed using the form sections and step-down forms disclosed herein the form sections are secured in their desired location by placing stakes 100*a-d*, 101 through a channel formed by the integral ribs of the corrugated plastic of the side walls at desired intervals along the side walls. In at least one preferred embodiment, an L-shaped leveling device 102 can be placed over the end of the stake that protrudes from the bottom edge of the side walls after the stakes have been inserted through the channels in the form sections. The stakes are then driven into the substrate below the form sections to secure the form in its desired position.

Figure 12:
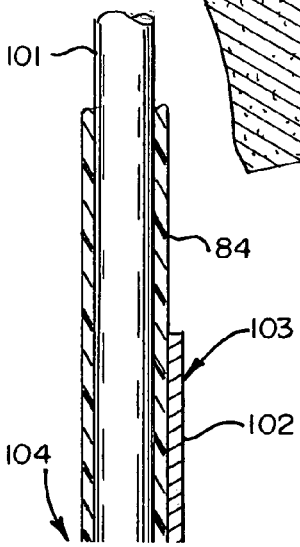
FIG. 12 is a cross-sectional view, taken along line 12-12 of FIG. 11,showing one embodiment of a form stake and a leveling device, as disclosed herein, used for leveling a form.

The leveling device for this embodiment can be seen by referring to FIG. 12, a cross sectional view taken along line 12-12 of FIG. 11, where a stake 101 is positioned in a channel of the corrugated plastic side wall 84. The L-shaped leveling device 102 has a hole communicating through the base 104 of the L so that the leveling device can be placed over the stake with the long stem 103 of the leveling device is against the outside surface of the side wall and oriented upward. The stake is then driven into the substrate below the form to secure the form in place and to provide lateral re-enforcement against the weight of the concrete when it is poured into the form.

After construction of the footing form is complete, it must be leveled. Leveling can be accomplished using a standard carpenter's level laid on the top edge of the form sections or it can be performed with surveying instruments or any other device suitable for checking the level of the form. To adjust the level of form having the embodiment of leveling device depicted in FIG. 12, the long stem 103 of the L-shaped leveling device 102 is pushed towards the stake 101 and the leveling device is moved upward along the stake. When the desired level is achieved, the long stem 103 of the L-shaped leveling device 102 is allowed to move away from the stake under the force of gravity, thus causing the hole in the base 104 of the L shaped leveling device 102 to bind on the stake and secure the form at its desired level. This procedure is performed for each stake until the entire foundation footing form is level.

While the stakes used for the forms can be constructed of any suitable material, three-eighths of an inch reinforcing bar is used to secure one preferred embodiment of the forms described herein. Other preferred embodiments can be secured and leveled using the embodiment of stake that is described below.

Figures 15, 16:
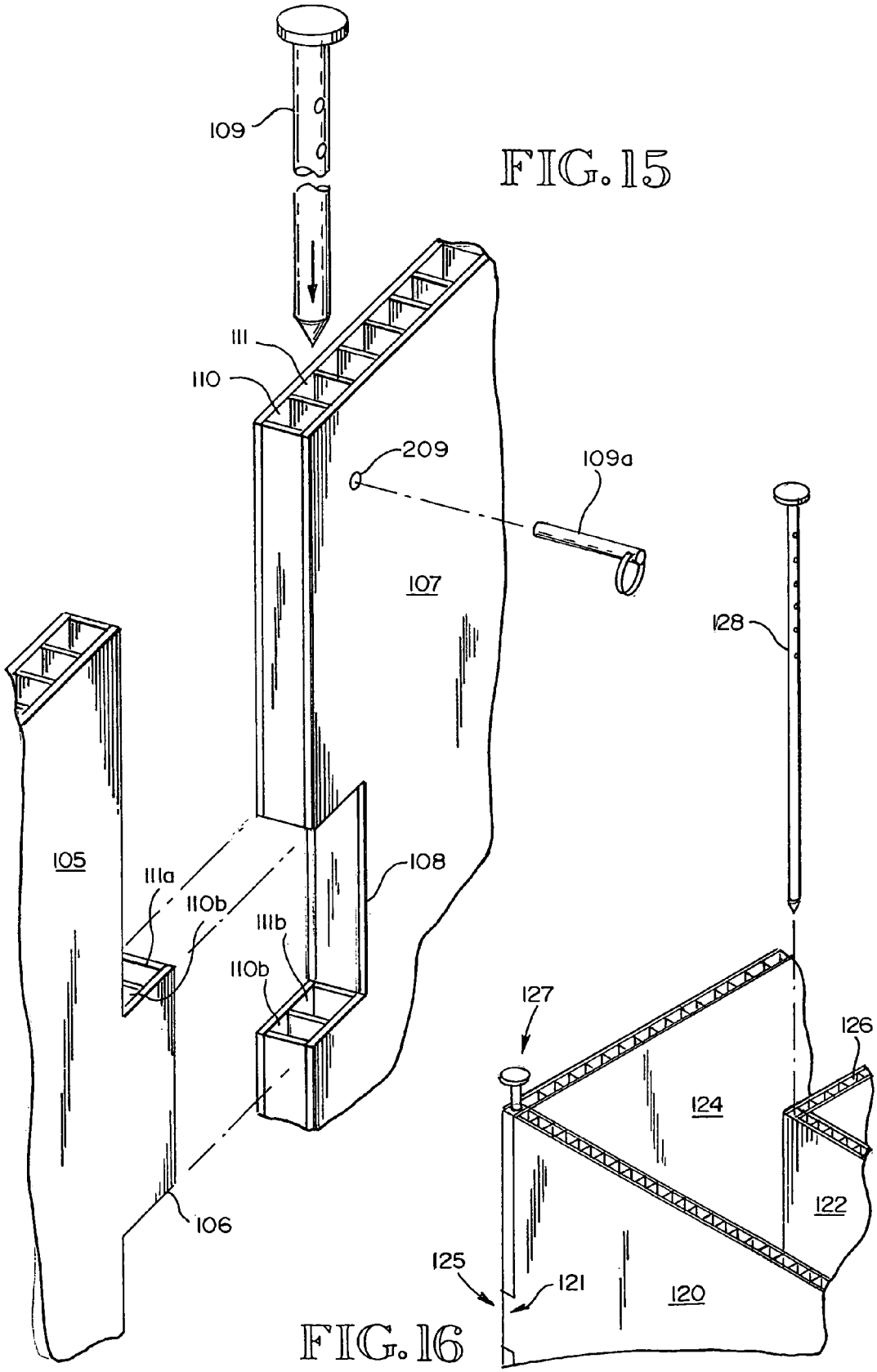
FIG. 15 is a perspective view showing the tab and notch connection used on form sections disclosed herein.
FIG. 16 is a perspective view of a corner formed using the form sections disclosed herein.

Referring to FIG. 15, one preferred embodiment of form section has a tab and notch system for connecting the form sections to each other when a plurality of sections are used to construct a foundation footing form. Each side wall at one end of each form section will have a tab that is made from the same piece of material as the form section, while the side walls at the other end will have a notch.

FIG. 15 shows how adjacent form sections of this preferred embodiment are attached to each other. The side wall 105 of one form section includes a tab extension 106 that protrudes from the end of the wall. The tab extension 106 is located such that the center of the tab is approximately half the distance between the bottom edge and the top edge of the side wall. The adjacent side wall 107 of an adjacent form section has a notch 108 that has a complimentary shape and location to the tab 106 such that the tab 106 can be placed in the notch 108 and the top and bottom edges of the adjacent form sections will line up with each other.

After the tab 106 has been placed in the notch and the form sections are placed in their desired alignment, a stake can be placed in the channel 110 or 111 at the end of the side wall 107 of the form section having the notch 108. The embodiment of stake used in FIG. 15 must be placed in the channel that has a hole 209 communicating from the outer surface of the side wall into the channel between the interconnection ribs. In the depicted embodiment, the hole communicates into the second channel 111. The stake 109 then extends down into the complimentary channel 111*a* of the tab 106 and back into the channel 111*b* of the side wall 107 having the notch 108.

The stake 109 has a plurality of holes communicating therethrough for insertion of a pin 109*a*. To level a form using the embodiment of stake depicted in FIG. 15 after the stakes have been inserted into the substrate below the form, the side walls 105, 107 are raised from the substrate until they are level. The pin 109*a* is then inserted into the hole 209 and into the hole in the stake that is either aligned with the hole 209 in the side wall. If no hole on the stake is aligned with the hole in the side wall, the pin 109*a* is placed in a hole that is slightly above or below the hole in the side wall. Final adjustments to the level of the form can be made by inserting the stake 109 further into the substrate or withdrawing the stake slightly from the substrate as needed.

While not shown in the drawings, another embodiment of form sections that has tabs and notches similar to the sections depicted in the FIG. 15 is constructed such that the opposing side walls at a given end of the form will have opposite tab or notch configuration. Using the form sections in FIG. 15 as an example, in the form section having side wall 105, the side wall opposite side wall 105 will have a notch (similar to notch 108) at the end of the side wall that is directly opposite tab 106. The other end of side wall 105 will have a notch, while the side wall directly opposite 105 will have a tab at the same end. Thus, in the embodiment described immediately above, each end of each form section has one side wall with a tab and one side wall with a notch.

In at least one preferred embodiment of form sections, the walls are off set such that the end of one side wall in the form section will extend past the end of the opposing wall of the form section. The distance that the end extends past the end of the opposing side wall is equal to the width of the foundation footing. Therefore, there is an off set at each end of the form section such that the intersection of two side walls of adjacent form sections will never be directly across a form section from another side wall intersection and the form sections will not need to be cut to form a corner in the foundation footing.

FIG. 16 shows a form section having a pair of opposing side walls 120, 122 forming a corner of a foundation form with an adjacent form section having walls 124, 126. The outer side walls 120, 124 are offset such that they extend past the ends of the inner side walls 122, 126 by a distance equal to the width of the foundation footing thereby allowing a corner to be formed without cutting the form sections or using additional material.

The embodiment of the current invention depicted in the figure includes the tab and notch connectors. After the form sections are placed in their desired location, stake 127 is inserted into a channel in the corrugated plastic side wall 124 such that the tab 121 on the adjacent side wall 120 is secured in the notch 125. The inner side walls 122, 126 are secured in the same manner by another stake 128 and the stakes are driven into the substrate below the form sections. The form sections can then be leveled.

While both ends of the form section are not shown in the figure, the corrugated plastic side walls are both the same lengths. For example, FIG. 16 shows a form section having two opposing side walls 120, 122 wherein the end of wall 120 extends past the end of wall 122 in the figure, while it is not depicted in the figure at the other end of the form section of this preferred embodiment the end of wall 122 will extend past the end of wall 120.

Figure 17:
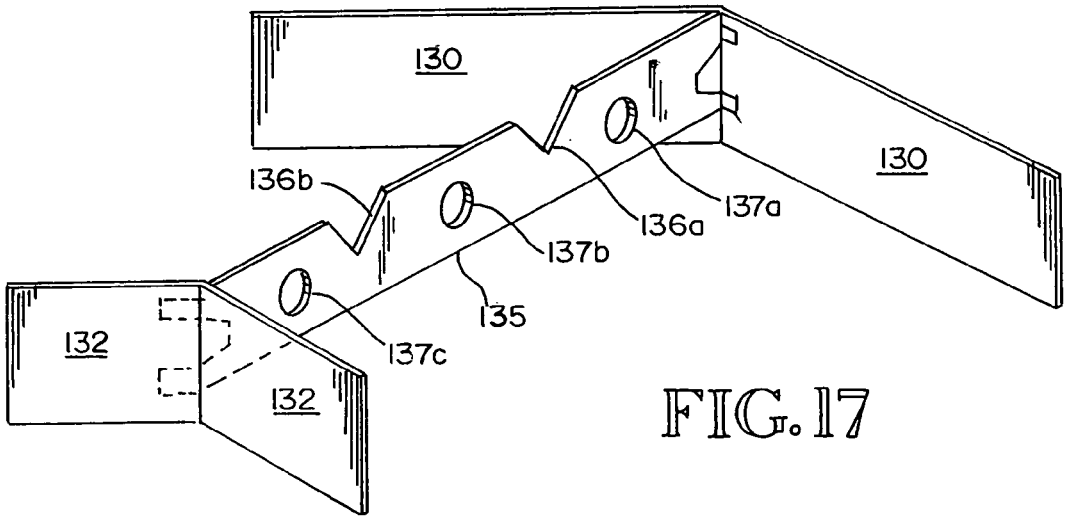
FIG. 17 is a perspective view of a corner form section according to the disclosure herein.

FIG. 17 shows a preferred embodiment of a form for corners in a foundation footing. The corner form has outer side walls 130 and inner side walls 132, which are connected to each other by connecting support 135. The support 135 is similar to the connecting support shown in FIG. 5 in that it is connected to the side walls using adhesives or mechanical fasteners. The connecting support has a pair of reinforcing bar support notches 136*a*, 136*b* and holes 137*a-c* for concrete communication through the connecting support. The top edge of the connecting support is below the top edge of the side walls of the corner form and the bottom edge of the connecting support is above the bottom edge of the connecting support, so that concrete can flow above and below the connecting support to ensure uniform strength of the concrete along the length of the foundation footing.

The connecting supports in the embodiment depicted in FIG. 17 can also include devices for holding vertical reinforcing bar, and they can also include stiffeners similar to the reinforcing bar holding devices and stiffeners described for the connecting support shown in FIG. 5. Additionally, other embodiments of the corner forms of the current invention can have supports similar to the top support 6 and the bottom support 12 shown in FIG. 2 and described above.

In use, the corner form section is connected to a form section on each side such that the walls 130 and 132 both have a ninety degree bend at the approximate center point along the long axis of the walls. The corner form section is then secured to the substrate, and can be leveled as described above. Reinforcing bar can also be inserted into the corner form section if desired.

Figure 18:
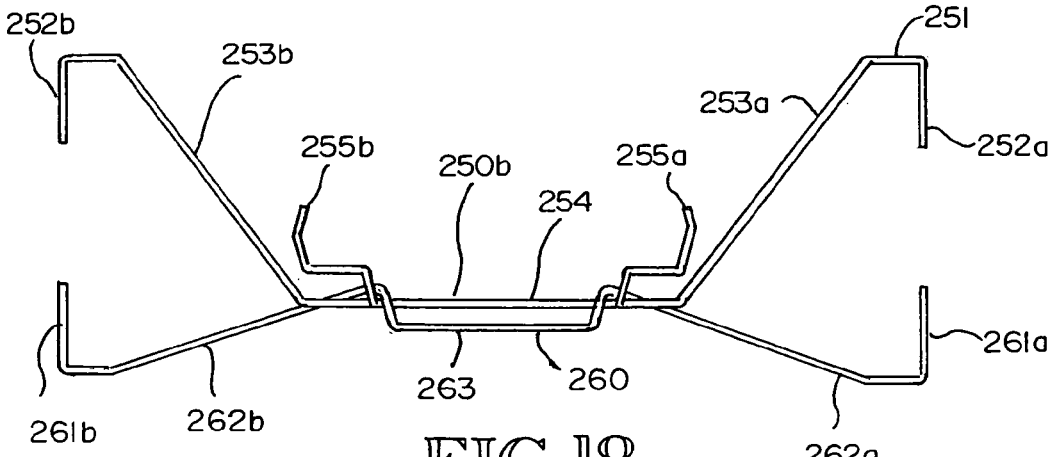
FIG. 18 is a perspective view of another embodiment of an interlocking connection device according to the disclosure herein.

Referring to FIG. 18, there is shown one preferred embodiment of an interlocking connection device 250 for the footing forms disclosed herein. The device 250 has a top support 251 that is configured so that it can be placed in the space between the two side walls of a form section. The support 251 has ends 252*a*, 252*b* that are bent such that the ends are configured for placing into the space between the integral interconnecting ribs of the corrugated plastic (channels) located on the top edge of the side walls such that the top support 251 will rest on the top edge of the side walls. The support also has a pair reinforcing bar guide members 253*a*, 253*b* that are angled down and into the space between the side walls when the device is in use.

The top support cross member 254 is connected to the reinforcing bar guide members 253*a*, 253*b* and is oriented at a right angle to the side walls when the form section is secured in place. The top support has a reinforcing bar holding portions 255*a*, 255*b* to secure any horizontal reinforcing bar that is supported by the device. Reinforcing bar placed in the footing form would slide down the guide members 253*a*, 253*b* and come to rest on the area of the top support under the holding portions. When concrete is poured into the form, the holding portions 255*a*, 255*b* keep the concrete from floating up into the form.

The bottom support 260 has ends 231*a*, 261*b* that are bent such that the ends are configured for placing in the channels located on the bottom edge of the side walls of a form section. Angled bottom support leg members 262*a*, 262*b* angle upward into the area between the two side walls when the form is in use. The leg members 262*a*, 262*b* are connected to a bottom support cross member 263 that is located within the form section between the side walls.

To assemble a form section using the embodiment of the interlocking connection device disclosed in FIG. 18, the first end 252*a* of the top support 251 is placed in a channel on one of the side walls and the second end 252*b* of the top support is placed in a channel of the opposite side wall. The first end 261*a* of the bottom support 260 is placed in the same channel of the same side wall as the first end 252*a* of the top support such that the first end of the bottom support is directly below the first end of the top support. The second end 261*b* of the bottom support is placed in the same channel of the same side wall as the second end 252*b* of the top support such that the second end of the bottom support is directly below the second end of the top support.

The bottom support cross member 263 is then pulled over top support cross member 254 thereby interlocking the bottom support with the top support. Additional top and bottom supports are placed along the length of the form section in the same manner.

FIG. 19 shows another preferred embodiment of an interlocking connection device 280 for the footing forms disclosed herein. The device 280 has a top support 281 that is configured so that it can be placed in the space between the two side walls of a form section. The support 281 has ends 282*a*, 282*b* that are bent such that the ends are configured for placing into the space between the integral interconnecting ribs of the corrugated plastic (channels) located on the top edge of the side walls such that the top support 281 will rest on the top edge of the side walls. The support also has a pair reinforcing bar guide members 283*a*, 283*b* that are angled down and into the space between the side walls when the device is in use.

The top support cross member 284 is connected to the reinforcing bar guide members 283*a*, 283*b* and is oriented at a right angle to the side walls when the form section is secured in place. The top support has a reinforcing bar support notches 285*a*, 285*b* to secure any horizontal reinforcing bar that is supported by the device. The top support has a vertical reinforcing bar holding loop 286 for placement of the base of an L shaped section of reinforcing bar.

The bottom support 291 has ends 292*a*, 292*b* that are bent such that the ends are configured for placing in the channels located on the bottom edge of the side walls of a form section. Angled bottom support leg members 293, 294 angle upward into the area between the two side walls when the form is in use. The leg members 293, 294 are connected to a bottom support cross member 295 that is located within the form section between the side walls.

To assemble a form section using the embodiment of the interlocking connection device disclosed in FIG. 19, the first end 282*a* of the top support 281 is placed in a channel on one of the side walls and the second end 282*b* of the top support is placed in a channel of the opposite side wall. The first end 292*a* of the bottom support 291 is placed in the same channel of the same side wall as the first end 282*a* of the top support such that the first end of the bottom support is directly below the first end of the top support. The second end 292*b* of the bottom support is placed in the same channel of the same side wall as the second end 282*b* of the top support such that the second end of the bottom support is directly below the second end of the top support.

The bottom support cross member 295 is then pulled over top support cross member 284 and the a vertical reinforcing bar holding loop 286 thereby interlocking the bottom support with the top support. Additional top and bottom supports are placed along the length of the form section in the same manner.

Once the bottom support and top support are interlocked, the ends of the supports will not come out of the channels of the side walls until the bottom support cross member is lifted out of the horizontal reinforcing bar notches and over the top support cross member. When the supports are interlocked, the side walls can be folded together by moving one of the side walls forward or backward, relative to the other side wall, along the long axis of the side wall and allowing the supports to pivot around the ends located in the channels such that the supports are sandwiched between the two side walls. The folded form sections can then be stacked for storage or transportation.

FIG. 20 shows another embodiment of a vertical reinforcing bar support 300 member for use to hold vertical sections of reinforcing bar in the form sections disclosed herein. Embodiments of the support member 300 shown in the figure, have a first end 301*a* and second end 301*b* that are configured for placement in the channels of the corrugated side walls, side wall engaging areas 302*a*, 302*b* rest on the top edge of the side wall when the member is used in a form as disclosed herein. The member also has angled portions 303*a*, 303*b* which angle down and into the area between the two side walls when the member is used. A reinforcing bar holding loop 305, for securing the L-shaped section of reinforcing bar, is attached to the cross member 304.

When the embodiment of the support member shown in FIG. 20 is used, the reinforcing bar holding loop 305 is placed over the long stem of the L-shaped section of reinforcing bar such that the ends 301*a*, 301*b* are oriented downward towards the form section. The first end 301*a* of the vertical reinforcing bar support is then placed into the same channel in the corrugated plastic side wall that the first end of a top support is located in, and the second end 301*b* is placed in the same channel in the corrugated plastic side wall that the second end of the top support is located in. The vertical reinforcing bar support member 300 remains in the foundation footing after concrete has been poured into the form.

Figure 21:
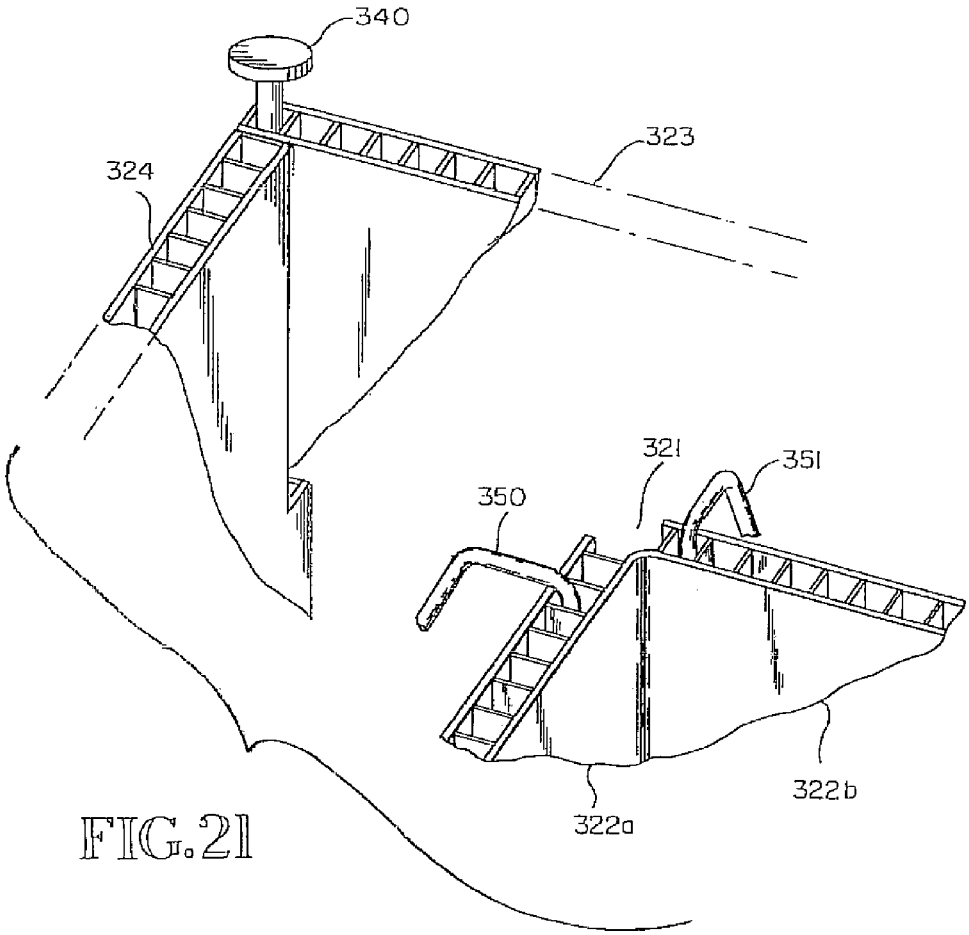
FIG. 21 is a perspective view of another embodiment of a corner form section according to the disclosure herein.

FIG. 21 shows another embodiment of a form section for a corner. The form section 320 has an interior wall 321, and two exterior wall panels 323, 324. The interior wall is scored thereby creating an integral hinge 335 so that the wall can be bent. The interior wall has a pair of interior corner panels 322*a*, 322*b* that are essentially the same size, one on each side of the integral hinge 335. The interior wall 321 is connected to the exterior wall panels 323, 324 using a plurality of interlocking connection devices. The interior wall and exterior wall panels each have a notch on one end of the long axis thereof and a tab on the other end.

To use the embodiment of a corner form section depicted in FIG. 21, the section is placed in a desired location for a corner. The section is aligned such that the tabs 327, 328 at the end of the interior wall 321 and one of the exterior wall panels 324 can be connected with the notches on an adjacent form section and the notches 329, 330 at the other end of the interior wall 321 and the end of the other exterior wall panel 323 can be connected with the tabs on the form section adjacent to the notches. The tab on one of the exterior wall panels 323 is placed into the notch on the other panel 324 and a stake 340 us used to connect the two panels. If desired, reinforcing bars can be placed in the form, and the form can be leveled.

For most conventional construction projects, the substrate that will support the foundation footer is generally prepared by leveling the site to a rough flat surface. If the construction site is too sloped to allow leveling of one surface that will accommodate the entire structure to be built, additional areas are leveled at elevations above or below the initial surface and the substrate adjacent the differently leveled surfaces is prepared such that it has a vertical face. In some cases, a trench is prepared for placement of the foundation footing form.

When the forms of the current invention are used, on a conventionally prepared site, form sections are laid end to end in the desired outline of the foundation footing. If step down forms are needed, they are assembled and placed in the appropriate positions as described above. After the form sections have been properly positioned, they are secured using stakes placed in a channel of the corrugated plastic side walls of the form sections and pounded into the substrate below the form sections.

Adjacent form sections can be secured to each other using stakes through tab and notch connectors as described above. Alternatively, a U-shaped stake (not shown in the figures) can be used such that one leg of the U-shaped stake is placed in a channel in the corrugated plastic side wall of one form section and the other leg is placed in a channel of the adjacent side wall of the adjacent form section. Additionally, clips configured for placement in the channels of adjacent side walls (also not depicted in the figures) can be used such that a clip is placed in the channels of adjacent side walls on both the top edge and the bottom edge of the side walls.

If any part of any form section is too long for a space in the foundation footing form, it can be easily trimmed so that it can fit in the available space. Corners in the foundation footing can be formed using special corner form sections or using standard form sections not designed specifically for corners.

After the form sections have been secured in position, horizontal and vertical reinforcing bar is placed in the forms and the level of the form is checked. The step down forms are not secured in position until the reinforcing bar has been placed in the form section on the lower level. If the form is not level, the level can be adjusted as described above. Concrete is then poured into the space between the side walls of the form and screeded to level the top surface of the concrete. When the concrete has cured, the form can be left in place with no danger of attracting harmful insects such as ants and termites, or the side walls can be removed and reused.

INDUSTRIAL APPLICABILITY

The invention has applicability in the field of construction using concrete. In particular the current invention describes a number of embodiments of form sections, step down forms, reinforcing bar supports, and leveling devices for foundation footing forms. The embodiments of the form sections disclosed above are light weight, moisture resistant, easily stacked and easily stored. Form sections sufficient to construct a foundation footing form for a single family house can be easily transported to a construction site in a standard pickup truck. The form sections of the current invention can be easily installed in less time by fewer laborers than forms made from materials that are generally used.

In compliance with the statute, the invention has been described in language more or less specific as to structural features. It is to be understood, however, that the invention is not limited to the specific features shown, since the means and construction shown comprise preferred forms of putting the invention into effect. The invention is, therefore, claimed in any of its forms or modifications within the legitimate and valid scope of the appended claims, appropriately interpreted in accordance with the doctrine of equivalents.

What is claimed is:

1. A form section comprising:

a pair of substantially planar side walls made from corrugated plastic having spaced, integral interconnecting ribs between two facing sheets of plastic, each side wall having a long axis, a first end, a second end, an interior surface, an exterior surface, a top edge, and a bottom edge;

the side walls being constructed such that channels created by the integral interconnecting ribs are open at the top edge and the bottom edge of the side walls;

means for connecting the side walls to each other such that the interior surfaces of the side walls face each other the means for connecting the side walls to each other such that the interior surfaces of the side walls face each other is an interlocking support having a top support and a bottom support;

the top support having ends that are configured for insertion into a space between the integral interconnecting ribs of the corrugated plastic at the top of the side walls such that the top support will rest on the top edge of the side walls;

the top support further having a reinforcing bar guide member extending from each end downward into the space between the two side walls to a top support cross member that spans the space between the guide members;

the bottom support having ends that are configured for insertion into the space between the integral interconnecting ribs of the corrugated plastic at the bottom of the side walls;

the bottom support further having a support leg extending from each end upward into the space between the two side walls to a bottom support cross member that spans the space between the support legs; and;

the bottom support cross member is pulled over the top support cross member, the top support and the bottom support are interlocked;

means for supporting horizontal reinforcing bars within the form section;

means for securing vertical reinforcing bars within the form section;

means for securing the form section in a desired location; and means for ensuring that the form section is level.

2. The form section of claim 1 wherein the top support further includes an area at each end of the top support cross member that is configured for supporting a horizontally oriented reinforcing bar that is placed in the form section.

3. The form section of claim 1 wherein the top support further includes a vertical reinforcing bar holding portion that is configured to secure the base of an L-shaped section of reinforcing bar in the form section.

4. The form section of claim 1 wherein the means for securing vertical reinforcing bars within the form section is said top support and a vertical reinforcing bar support;

the top support being configured for securing the base of an L-shaped section of reinforcing bar within the form section;

the vertical reinforcing bar support having ends that are configured for insertion into the space between the integral interconnecting ribs of the corrugated plastic at the top of the side walls; and the vertical reinforcing bar support being further configured for securing the long stern of an L-shaped section of reinforcing bar so that the reinforcing bar will not rotate back into the form section.

5. The form section of claim 1 wherein the means for securing the form section in a desired location is a plurality of stakes configured for insertion into the space between the integral interconnecting ribs of the corrugated plastic of the side walls and into a substrate beneath the form section.

6. The form section of claim 5 wherein the means for ensuing that the form section is level is a plurality of L shaped leveling devices; and the base of each leveling device has a hole communicating therethrough for securing the form section in a desired location.

7. The form section of claim 5 wherein each stake has a plurality of holes communicating therethrough, the form section side walls have a plurality of holes communicating therethrough; and the form section can be leveled by inserting a pin into one of the holes in each stake used, through one of the holes in the side walls.

8. A form section comprising:

a pair of substantially planar side walls made from corrugated plastic having spaced, integral interconnecting ribs between two facing sheets of plastic, each side wall having a long axis, a first end, a second end, an interior surface, an exterior surface, a top edge, and a bottom edge;

an interlocking connection device having a top support and a bottom support;

the top support having ends that are configured for insertion into a space between the integral interconnecting ribs of the corrugated plastic at the top of the side walls;

the top support being configured to support a reinforcing bar within the form;

a plurality of reinforcing bar support members having ends that are configured for insertion into the space between the integral interconnecting ribs of the corrugated plastic at the top of the side walls;

the reinforcing bar support members being configured to secure a vertical reinforcing bar within the form section;

a bottom support having ends that are configured for insertion into the space between the integral interconnecting ribs of the corrugated plastic at the bottom of the side walls;

the top support and the bottom support being further configured such that when the ends of the top support are inserted into the side walls and the ends of the bottom support are inserted into the side wall directly below the ends of the top support on the side walls, the top support and the bottom support can be interlocked; and a plurality of stakes configured for insertion into the space between the integral interconnecting ribs of the corrugated plastic of the side walls and into a substrate below the form section.

9. The form section of claim 8 wherein each stake has a plurality of holes communicating therethrough, the form section side walls have a plurality of holes communicating therethrough; and the form section can be leveled by inserting a pin into one of the holes in each stake used, through one of the holes in the side walls.

10. The form section of claim 8 wherein the side walls have a rectangular tab extending from either the first end or the second end and a rectangular notch in the other end;

the notch being located at a position on the end of the side walls such that it would be complimentary to a tab on an adjacent side wall of an adjacent form section;

the side walls being oriented such that the notch on one of the side walls is on an end corresponding to the tab on the other of the side walls;

whereby the form section can be secured to another form section by insertion of a stake into the space between the integral interconnecting ribs of the corrugated plastic at the end of a side wall having a notch and into the integral interconnecting ribs of the corrugated plastic of the tab on the end of a side wall of an adjacent form section.

11. The form section of claim 8 wherein the side walls are a first side wall and a second side wall and the ends of the side walls are offset such that the first end of the first side wall extends farther than the first end of the second side wall by a distance equal to the width of the form section; and the second end of the second side wall extends farther than the second end of the first side wall by a distance equal to the width of the form section.

* * * * *